US006486419B2

(12) United States Patent
Horiguchi et al.

(10) Patent No.: US 6,486,419 B2
(45) **Date of Patent: *Nov. 26, 2002**

(54) MULTIFUNCTIONAL IMAGE FORMING APPARATUS HAVING A COVERED MAIN POWER SWITCH

(75) Inventors: Shigeru Horiguchi, Kawasaki (JP); Yuki Nanri, Tokyo (JP); Kazuyuki Saitoh, Tokyo (JP); Yuji Suzuki, Yokohama (JP); Masahiro Nakajima, Tokyo (JP); Tetsuya Gotoh, Yokohama (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/227,033

(22) Filed: Jan. 11, 1999

(65) Prior Publication Data

US 2002/0056630 A1 May 16, 2002

(30) Foreign Application Priority Data

Jan. 9, 1998 (JP) ..... 10-015169

(51) Int. Cl.[7] ..... H01H 9/00
(52) U.S. Cl. ..... 200/43.19; 200/333
(58) Field of Search ..... 200/43.01, 43.16, 200/43.18–43.22, 50.01, 50.02, 50.1, 293, 308, 310, 317, 333; 361/679, 686, 724, 837

(56) References Cited

U.S. PATENT DOCUMENTS

| | | | | | |
|---|---|---|---|---|---|
| 3,643,042 | A | * | 2/1972 | Gratz | 200/16 D |
| 3,883,705 | A | * | 5/1975 | Sebastian et al. | 200/6 B |
| 4,623,765 | A | * | 11/1986 | Leyden | 200/43.22 |
| 4,638,129 | A | * | 1/1987 | Partus et al. | 200/43.22 |
| 4,896,190 | A | * | 1/1990 | Uchida et al. | 355/202 |
| 4,898,009 | A | * | 2/1990 | Lakoski et al. | 70/58 |
| 5,038,284 | A | * | 8/1991 | Kramer | 364/408 |
| 5,862,437 | A | * | 1/1999 | Kutsuwada et al. | 399/88 |
| 6,075,958 | A | * | 6/2000 | Gotoh et al. | 399/124 |
| 6,226,475 | B1 | * | 5/2001 | Kabumoto et al. | 399/107 |

FOREIGN PATENT DOCUMENTS

JP 8-339108 A * 12/1996 ..... G03G/15/00

* cited by examiner

*Primary Examiner*—Michael Friedhofer
(74) *Attorney, Agent, or Firm*—Oblon, Spivak, McClelland, Maier & Neustadt, P.C.

(57) ABSTRACT

An image forming apparatus having at least two of a plurality of functions including copying, facsimile and printer functions includes a main power switch that is provided on an outer surface of the apparatus and a cover to cover the main power switch. The cover is capable of opening and closing. Because the main power switch cannot be operated unless the cover is opened, when a user inadvertently tries to turn off the main power switch, for example, at the end of a day, the user must first touch the cover and is thereby reminded that the switch which the user is trying to turn off, is actually the main power switch for the apparatus. Thus, the main power switch is prevented from being inadvertently or unconsciously turned off.

6 Claims, 6 Drawing Sheets

MULTIFUNCTIONAL IMAGE FORMING APPARATUS HAVING A COVERED MAIN POWER SWITCH

BACKGROUND OF THE INVENTION

1. Field of the Invention

The present invention relates to a multifunctional image forming apparatus having a plurality of functions including copying, facsimile and printer functions.

2. Discussion of the Background

An image forming apparatus having a plurality of functions including copying, facsimile and printer functions is widely used and generally called a multifunctional image forming apparatus. Such a multifunctional image forming apparatus is typically constructed as a copying machine and includes additional parts for performing facsimile and printer functions. The apparatus generally includes an operational panel which can be used not only for a copying operation but also for facsimile or printer operations.

When the multifunctional image forming apparatus is operated only as a copying machine, a user typically turns on the power of the apparatus when the user starts using the apparatus for a day, for example, first in the morning, and turns off the power of the apparatus when the user finishes using the apparatus for the day, for example, at the end of the day. However, when the same apparatus is also used as a facsimile machine, the power of the apparatus must be always kept on, for example, even after the end of the day so as to receive an incoming facsimile at any time. Therefore, the multifunctional image forming typically has two separate power on/off switches, one for turning on/off the power of an image forming part of the apparatus, that is used for facsimile and printer functions and which is typically called a main power switch for the apparatus, and one for turning on/off the power of a part of the apparatus for a copying operation. For using the apparatus for a copying operation, after the main power switch is turned on, the power on/off switch for a copying operation must be turned on. For using the apparatus as a facsimile machine or a printer, only the main power switch must be turned on. The main power switch is typically a toggle type switch and is provided, for example, at a side plate of the main body of the apparatus, and the power on/off switch for a copying operation is generally a push type switch and is generally provided in an operational panel provided on an upper plate of the main body of the apparatus.

When a user has been using a regular copying machine having only a copying function and is not familiar with the multifunctional apparatus as described above, the user tends to turn off the main power switch of the apparatus, for example, at the end of a day, and thereby a problem is caused that the apparatus is disabled to receive an incoming facsimile after the end of the day.

SUMMARY OF THE INVENTION

In order to overcome the above-described and other problems with background apparatus, preferred embodiments of the present invention provide a multifunctional image forming apparatus which is capable of preventing the main power switch of the apparatus from being inadvertently turned off by the user.

Preferred embodiments of the present invention further provide a multifunctional image forming apparatus which has a main power switch and at least another switch for turning on/off a function of the apparatus and in which the operability of these two switches are improved such that an unnecessary operation of turning on/off the main power switch is prevented.

According to a preferred embodiment of the present invention, an image forming apparatus having at least two of a plurality of functions including copying, facsimile and printer functions includes a main power switch that is provided on an outer surface of the apparatus and the main power switch is covered by a cover capable of opening and closing. Because the main power switch cannot be operated unless the cover is opened, when a user inadvertently tries to turn off the main power switch, for example, at the end of a day, the user must first touch the cover and is thereby reminded of that the switch the user is trying to turn off is the main power switch for the apparatus and that if the main power switch is turned off the facsimile functions will be disabled. Thus, the main power switch being inadvertently or unconsciously turned off by the user is prevented.

The cover may be made of a translucent material, such as for example, plastics, such that the user can easily recognize the location of the main power switch when needed.

The image forming apparatus may further include a switch to turn on/off at least one of the plurality of functions. The switch to turn on/off the at least one of the plurality of functions may be provided on an outer surface of the apparatus at a front side of the apparatus. In this case, the main power switch is also provided at the front side of the apparatus. Because both the main power switch and the power on/off switch for a copying operation are located at the front side of the apparatus, the user can more easily recognize that the switch that is covered by the cover is the main power switch for the apparatus and must not be inadvertently turned off.

Further, the cover may be made detachable from the apparatus. When the image forming apparatus is used simply as a copying machine, the cover may be omitted from the apparatus so as to reduce the cost of the apparatus.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTIONS OF THE PREFERRED EMBODIMENTS

Figure 1A:
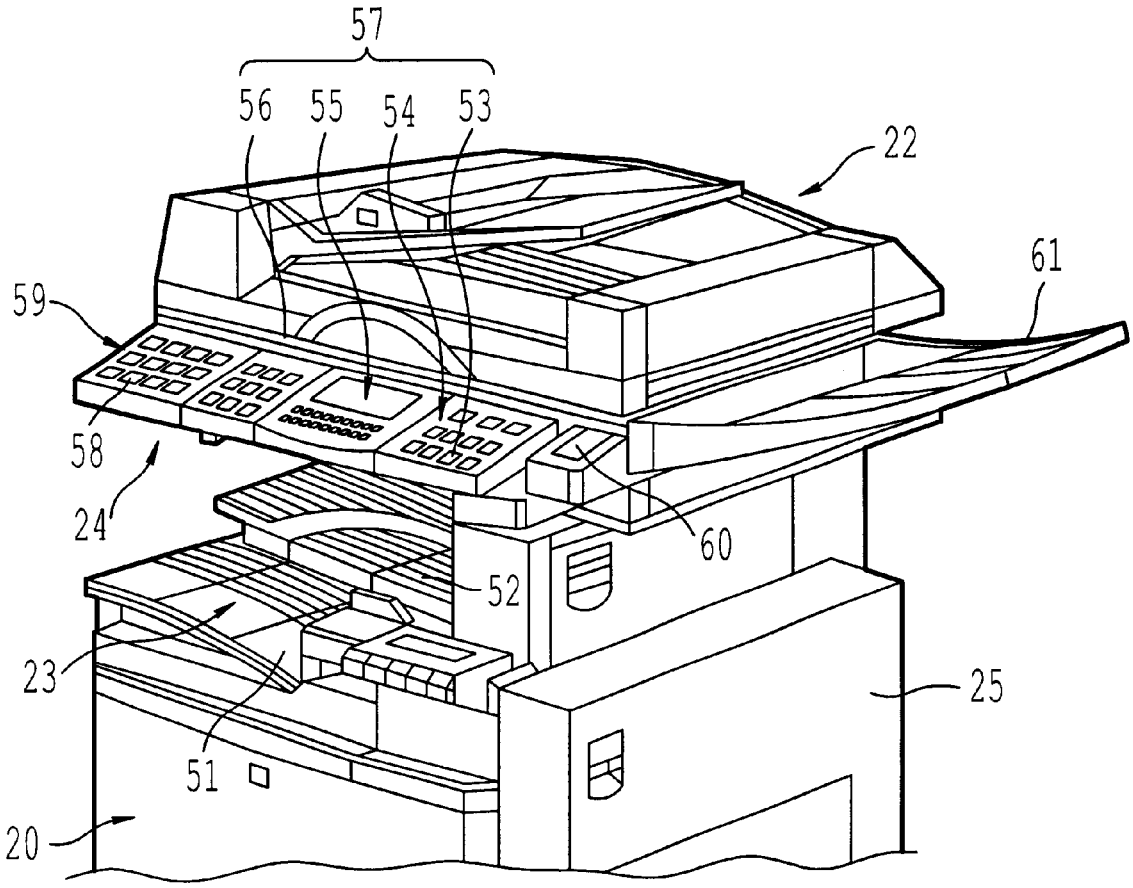
FIGS. 1(*a*) and 1(*b*) are perspective views illustrating an image forming apparatus according to a preferred embodiment of the present invention, from the front and back, respectively.

Referring now to the drawings, wherein like reference numerals designate identical or corresponding parts throughout several views, preferred embodiments of the present invention are now described.

Figure 1B:
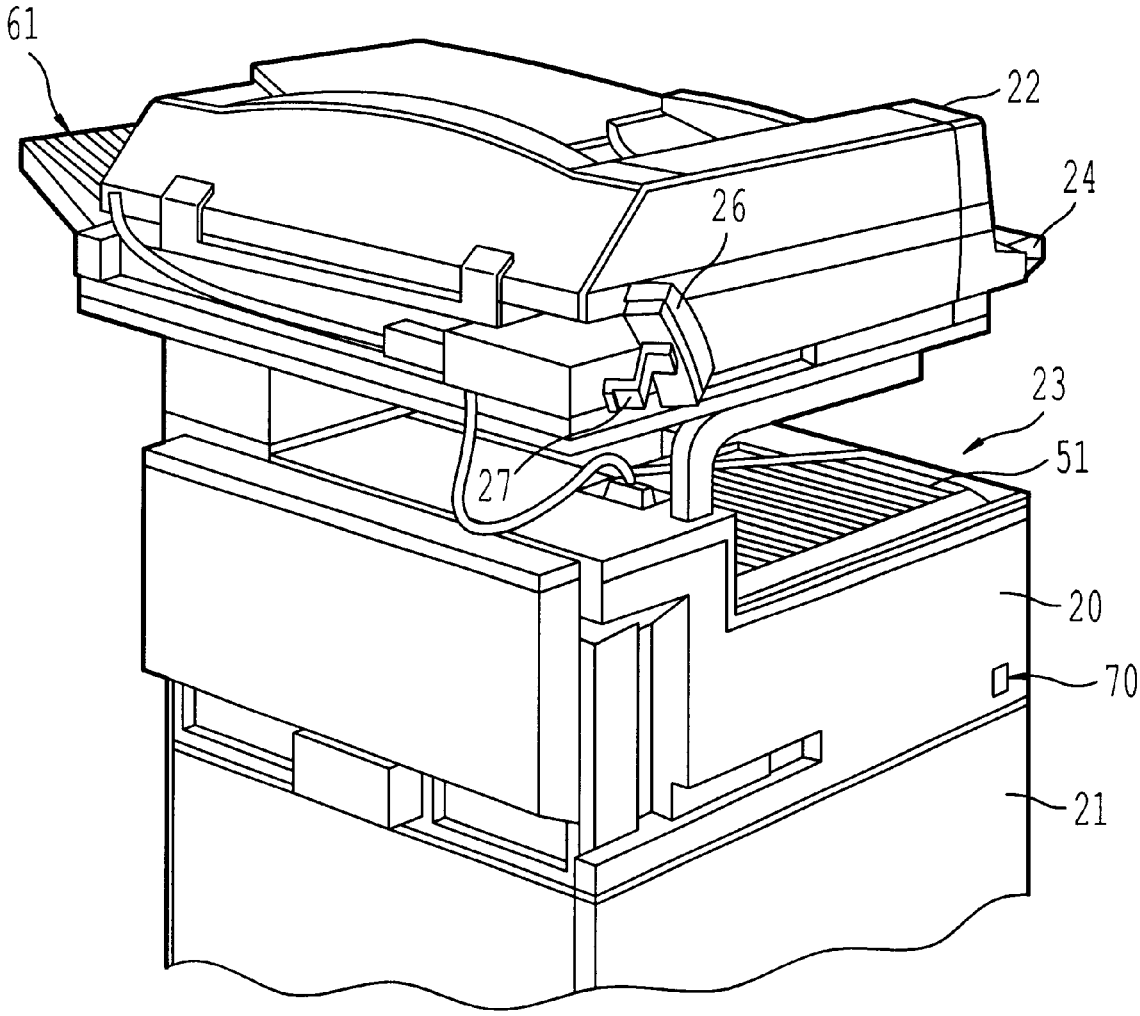

FIGS. 1(*a*) and 1(*b*) illustrate an image forming apparatus according to a preferred embodiment of the present invention, from the front and back, respectively. The image forming apparatus is a multifunctional image forming apparatus having a plurality of functions including, for example, copying, facsimile and printer functions. Numeral 20 denotes an image forming unit functioning as a printer. A sheet feed unit 21 is provided below the image forming unit 20, and an image reading unit 22 for reading an image of an original is provided above the image forming unit 20 with a space which is opened at the front and left side (the left side as viewed in FIG. 1(*a*)) being provided between the image reading unit 22 and the image forming unit 20. The space is used as a copy sheet accommodating part 23. An operational panel 24 for operating the plurality of functions is provided at a front side of a main body of the image reading unit 22. Numeral 25 denotes a manually fed sheet feeding device.

Figure 2:
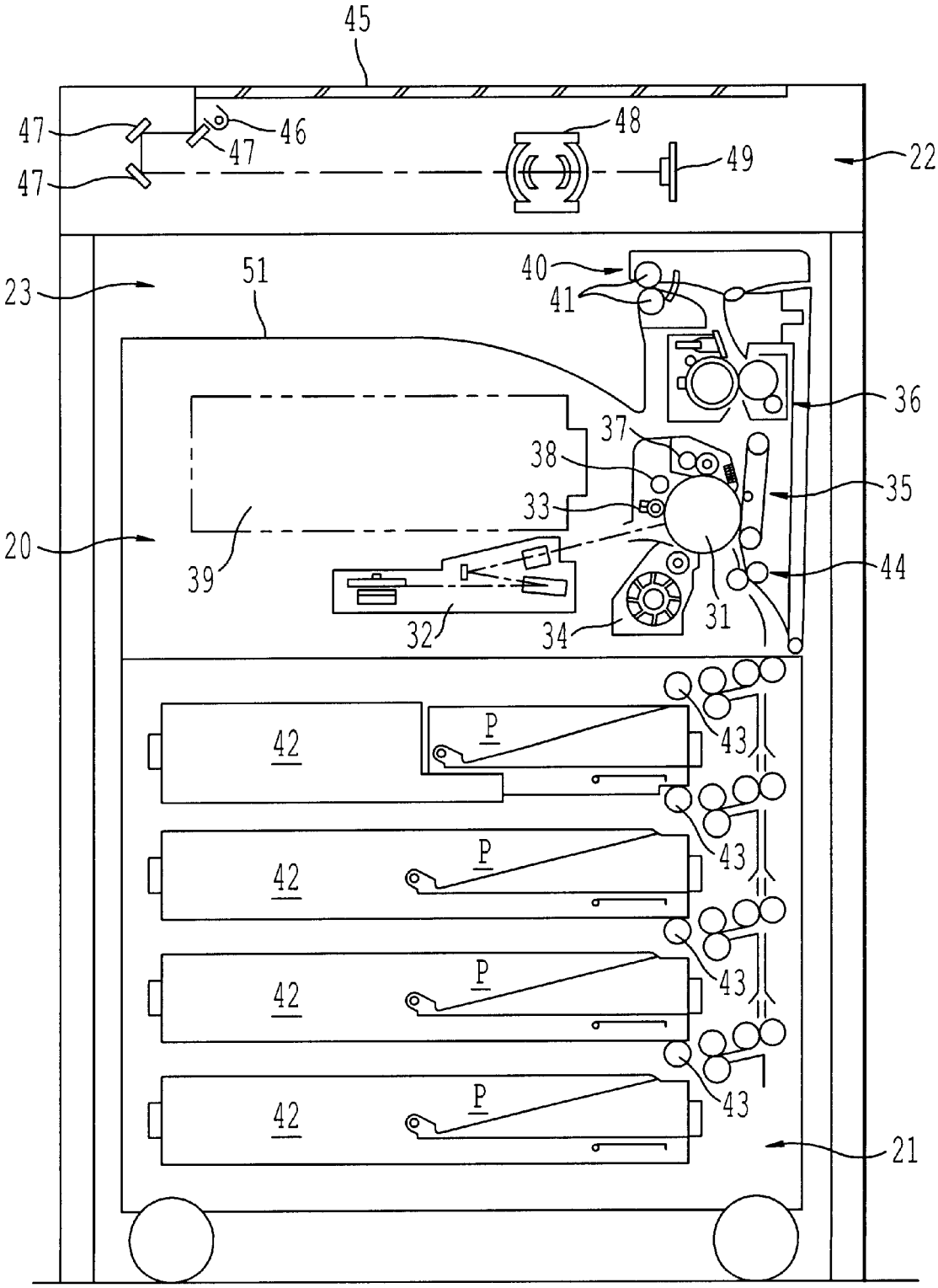
FIG. 2 is a sectional view illustrating the construction of the image forming apparatus illustrated in FIGS. 1(*a*) and 1(*b*)

FIG. 2 illustrates the construction of the image forming apparatus illustrated in FIGS. 1(*a*) and 1(*b*). The image forming unit 20 includes a photoconductor 31 as an image bearing member. An optical image writing unit 32 forms a latent image on a surface of the photoconductor 31. A charger 33 uniformly charges the surface of the photoconductor 31. A developing unit 34 develops a latent image with toner. A transfer unit 35 transfers a developed toner image onto a sheet of paper P and feeds the sheet of paper P to a fixing unit 36, which then fixes the toner image onto the sheet of paper P. A cleaning unit 37 removes residual toner and a discharger 38 removes a residual charge from the surface of the photoconductor 31. Numeral 39 denotes a toner bottle storing therein toner to be supplied to the developing unit 34. A copy sheet exit 40 includes a pair of exiting rollers 41 to exit the sheet of paper P carrying the fixed toner image thereupon to the copy sheet accommodating part 23.

The sheet feed unit 21 includes a plurality of sheet cassettes 42. A sheet of paper P is fed out from one of the sheet cassettes 42 by a feed roller 43 and is conveyed to the image forming unit 20 by a pair of registration rollers 44 at such a timing that the toner image is transferred thereupon from the photoconductor 31 at the image forming unit 20.

The image reading unit 22 includes a contact glass 45 to place an original thereupon. The image reading unit 22 further includes a light source 46 which emits a light to illuminate the original, a mirror 47, a lens 48 and a charge-coupled device (CCD) 49 which optically reads an image of the original and converts the read image into electrical signals. Image signals for the original obtained by the image reading unit 22 are processed by an image processing unit (not shown), and then form a latent image on a surface of the photoconductor 31 via the optical image writing unit 32.

The copy sheet accommodating part 23 includes an exit tray 51 which receives thereupon copy sheets exited from the copy sheet exit 40. The exit tray 51 is constructed, for example, of a plurality of plate-like shaped members, and is bent such that a part of the exit tray 51 at the side of the copy sheet exit 40 is lowered. As shown in FIG. 1(*a*), a bin tray 52 is provided above the exit tray 51 so as to divide the space into two parts such that the copy sheets exited from the copy sheet exit 40 are sorted.

The operational panel 24 includes a copy function panel 57, which includes a copy start key 53, a ten-key pad 54, a liquid crystal display 55, a copy operation panel 56 and so forth. The operational panel 24 further includes a facsimile function panel 59 including dialing keys 58 and so forth. The copy function panel 57 and the facsimile function panel 59 are arranged so as to extend along the entire width of the copy sheet accommodating part 23. Numeral 60 denotes a power on/off switch for a copying operation. A push type switch is used in this embodiment for the copying operation power switch 60.

A main power switch 70 for the apparatus, according to the preferred embodiment of the present invention, is provided at a side plate of the image forming unit 20. The switch 70 functions as a power on/off switch for the image forming unit 20.

Figure 3A:
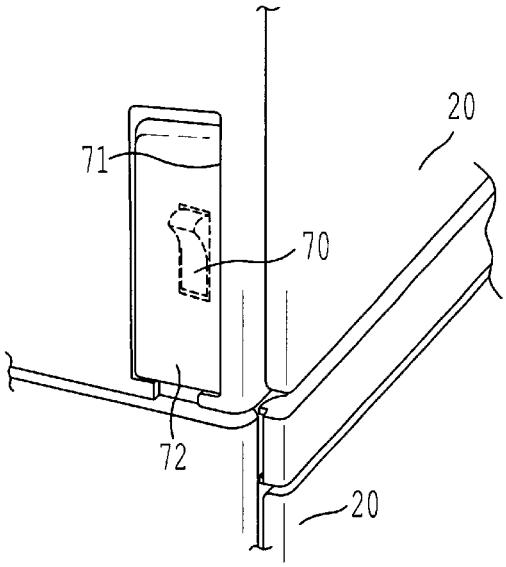
FIGS. 3(*a*) and 3(*b*) are perspective views illustrating a main power switch of the image forming apparatus illustrated in FIGS. 1(*a*) and 1(*b*) when a cover of the main power switch is closed and when the cover of the main power switch is opened for operating the main power switch, respectively.
Figure 3B:
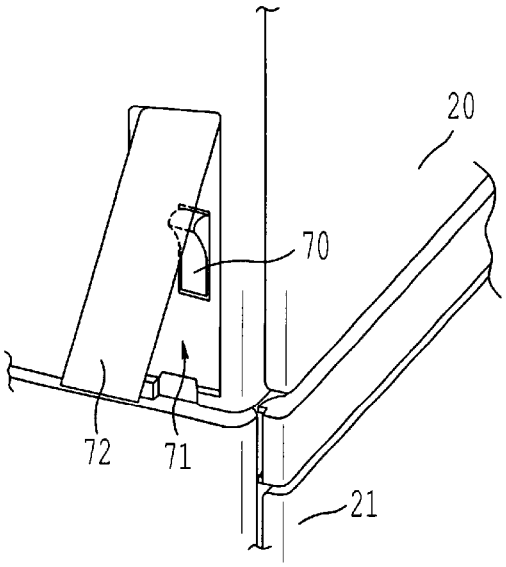

FIGS. 3(*a*) and 3(*b*) illustrate the main power switch 70 when a cover of the switch 70 is closed and when the cover of the switch 70 is opened for operating the switch 70, respectively. In this embodiment, as illustrated in the drawings, a toggle type switch is used for the main power switch 70. However, other types of switch may be used. The switch 70 is placed in a concave part 71 provided at the side plate of the image forming unit 20. A cover 72 is attached to the concave part 71 so as to open and close. An upper end part of the cover 72 is pivoted to an upper end part of the concave part 71 such that the cover 72 rotates upward and downward with the upper end part thereof as the fulcrum. When a user removes his or her hand from the cover 72 after opening the cover 72, the cover 72 moves back to a position to close and cover the concave part 71 by its own weight. Therefore, the main power switch 70 is prevented from being kept uncovered and exposed and thereby prevents the main power switch 70 from being unnecessarily turned off.

The cover 72 may be pivoted, for example, using a pin (not shown), such that the cover 72 can be detached from the apparatus. By using such a detachable cover, when the multifunctional image forming apparatus is used simply as a copying machine, the cover 72 may be omitted from the apparatus so as to reduce the cost of the apparatus.

The cover 72 may be made of translucent material, such as for example, plastics, such that the main power switch 70 inside the concave part 71 can be seen even when the switch 70 is covered by the cover 72. Because the main power switch 70 can not be touched unless the cover 71 is opened, when a user inadvertently intends to turn off the main power switch 70, for example, at the end of a day, the user must first touch the cover 72 in order to open the cover 72. The user must then rotate the cover 72 upward as illustrated in FIG. 3(*b*) so as to open the concave part 71 in order to operate the main power switch 70. Therefore, through such operations, the user is reminded of that the switch the user is trying to turn off is the main power switch for the apparatus and if the main power switch 70 is turned off the facsimile function will be disabled. The user then must determine whether or not to turn off the main power switch. Thus, the user is prevented from turning off the main power switch unintentionally or unconsciously.

Returning to FIG. 1(*b*), numeral 26 denotes a handset for a facsimile operation. The handset 26 is attached to a receiving plate which is attached to a part of the image reading unit 22. As illustrated in FIG. 1(*b*), the handset 26 is slanted. The handset 26 is typically provided at a rear part of a side plate of the image reading unit 22 so as to facilitate maintenance of the apparatus from the side of the. apparatus or to accommodate a copy sheet exit at the side plate of the image forming unit 22. However, if the handset 26 is provided at a part excessively close to the backside of the apparatus, the handset 26 protrudes a plane corresponding to the backside of the image reading unit 22 or the image forming unit 20. Accordingly, when the apparatus is placed by the wall, a space is created between the wall and the apparatus because of the protruded part of the handset 26, which increases the floor space occupied by the apparatus. This is uneconomical particularly in an area where the cost of office space is expensive. In addition, when the apparatus is installed by the wall, the handset 26 may inadvertently strike the wall and thereby become damaged or damage the wall. Therefore, in the image forming apparatus according to the preferred embodiments of the present invention, the handset 26 is inclined at a larger angle, such as for example, at an angle which brings the handset 26 closer to a vertical position, such that the handset 26 does not protrude the plane corresponding to the backside of the apparatus or protrudes only by a short distance.

Figure 4:
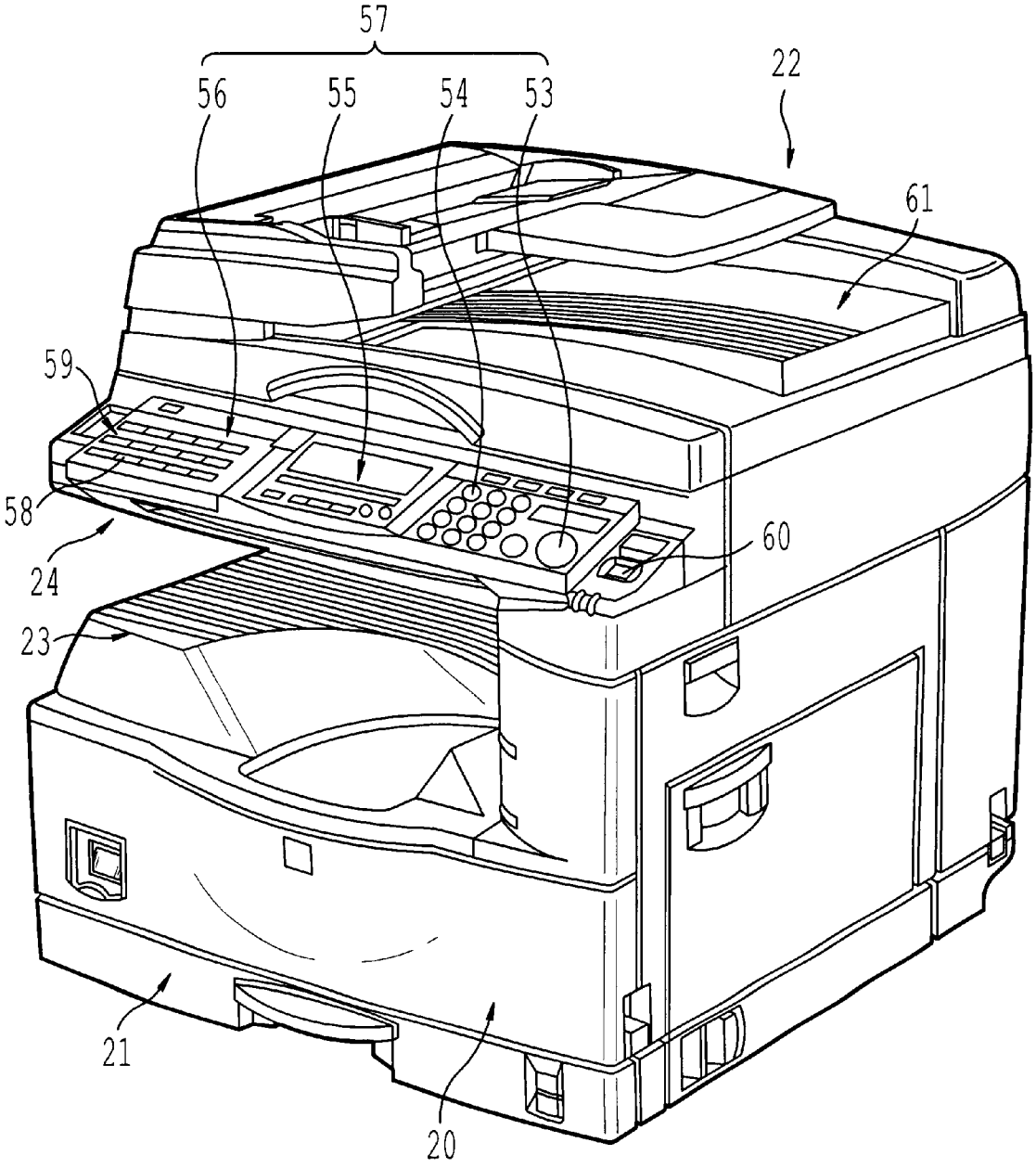
FIG. 4 is a perspective view illustrating an image forming apparatus according to another preferred embodiment of the present invention as viewed from the front.
Figure 5:
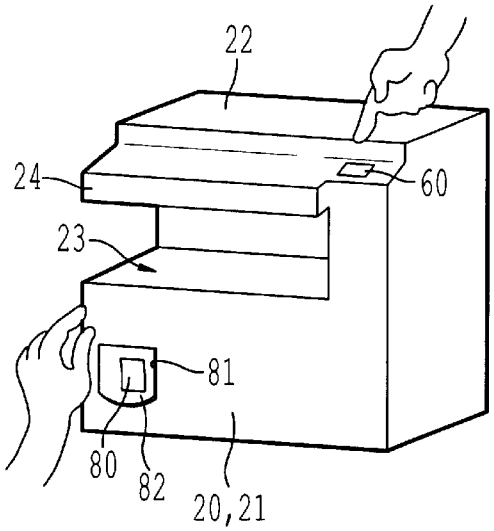
FIG. 5 is a schematic drawing of the image forming apparatus illustrated in FIG. 4, illustrating that both a main power switch and a power on/off switch for a copying operation are arranged at the front side of the apparatus.

FIG. 4 illustrates an image forming apparatus according to another preferred embodiment of the present invention as viewed from the front, and FIG. 5 schematically illustrates the image forming apparatus illustrated in FIG. 4. The image forming apparatus is also a multifunctional image forming apparatus having a plurality of functions including copying, facsimile and printer functions as in the previous embodiment. The construction of the present embodiment is similar to the previous embodiment, and therefore the explanation of the parts corresponding to the previous embodiment is omitted.

A main power switch 80 functions as the main power switch for the apparatus and functions as the power on/off switch for the image forming unit 20. As illustrated in FIG. 5, the main power switch 80 is provided at a front panel of the image forming unit 20, and a power on/off switch 60 for a copying operation is provided at an operational panel 24 which is provided at the front side of the apparatus. By thus providing both of these two switches at the front side of the apparatus, the apparatus is enabled to be placed by a wall without having a space between the side plate of the apparatus and the wall, and thereby the floor space occupied by the apparatus is minimized.

Figure 6A:
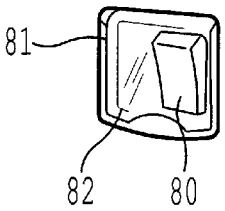
FIGS. 6(*a*), 6(*b*) and 6(*c*) are perspective views illustrating the main power switch of the image of forming apparatus illustrated in FIG. 4 when a cover is closed, when the cover is opened for operating the main power switch and when the cover is removed from a main body of the apparatus.
Figure 6B:
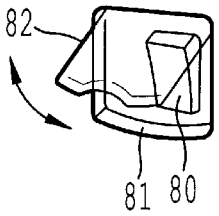
Figure 6C:
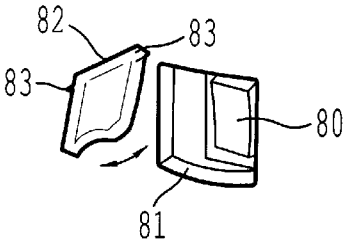

FIGS. 6(*a*), 6(*b*) and 6(*c*) illustrate the main power switch 80 when a cover is closed, when the cover is opened for operating the switch 80, and when the cover is removed from the apparatus. A toggle type switch is also used for the main power switch 80 in this embodiment. The toggle type main switch 80 is placed in a concave part 81 provided at the front plate of the image forming unit 20. A cover 82 is pivoted to the concave part 81 at an upper end part of the concave part 81 such that the cover 72 opens and closes by rotating upward and downward with the upper end part thereof as the fulcrum.

The cover 82 is made of translucent material, such as for example, plastics, such that the main power switch 80 can be seen from the outside when the cover 82 is closed. Because the main switch 80 cannot be operated unless the cover 82 is opened as in the previous embodiment, when a user inadvertently tries to turn off the main power switch 80, for example, at the end of a day, the user first touches the cover 82 and is thereby reminded that the switch which the user is trying to turn off is the main power switch 80 for the apparatus and that if the main power switch 80 is turned off, the facsimile function will be disabled. Further, because both the main power switch 80 and the power on/off switch 60 for a copying operation are located at the front side of the apparatus, the user can easily recognize that the switch which is covered by cover 82 is the main power switch 80 for the apparatus and must not be inadvertently turned off. Thus, the main power switch 80 is protected from being unintentionally or unconsciously turned off.

The cover 82 is also pivoted at the upper end portion of the cover 82 in this embodiment and therefore returns to a closed position to cover the concave part 81 by its own weight when the user removes his or her hand from cover 82. Therefore, the main power switch 80 is prevented from being kept uncovered and exposed and thereby the main power switch 80 is prevented from being unnecessarily turned off. In this embodiment, although a pair of pins 83 to pivot the cover 82 are illustrated in FIG. 6(*c*), other pivoting mechanism may be employed.

Further, the covers 72 and 83 may be made in a color which is different from the color of the front and side plates of the image forming unit 20, for example, in black or gray, such that the location of the main switches 70 and 80 can be easily recognized when a user intends to turn off the main power of the apparatus. Furthermore, the density of the color may be made sufficiently thin such that the main switches 70 and 80 in the inside can be seen through the covers 72 and 83 and be recognized.

Numerous additional modifications and variations of the present invention are possible in light of the above teachings. It is therefore to be understood that within the scope of the appended claims, the present invention may be practiced otherwise than as specifically described herein.

The document claims priority and contains subject matter related to Japanese patent application No. 10-015169 filed in the Japanese Patent Office on Jan. 9, 1998, the entire contents of which are hereby incorporated by reference.

What is claimed as new and desired to be secured by Letters Patent of the United States is:

1. An image forming apparatus having a facsimile function and a copying function, said image forming apparatus comprising:

an operational panel provided on an upper plate of the image forming apparatus and configured to operate the facsimile function and the copying function;

a common image reading unit configured to read an image for the facsimile function and the copying function;

a common printer unit configured to print the image for the facsimile function and the copying function;

a common exhausted sheet accommodating unit configured to receive sheets from said common printer unit, said common exhausted sheet accommodating unit being positioned above said common printer unit and below said common image reading unit;

a power switch provided on said operational panel and configured to turn on and off power to the copying function; and a main power switch configured to turn on and off power to said image forming apparatus, said main power switch provided on a front plate of the image forming apparatus and including a cover covering said main power switch.

2. The image forming apparatus according to claim 1, wherein said cover is configured to move between a first position in which said cover covers said main power switch and a second position in which said main power switch is uncovered.

3. The image forming apparatus according to claim 1, wherein said cover is made of a translucent material.

4. The image forming apparatus according to claim 1, wherein said cover is detachable from said image forming apparatus.

5. The image forming apparatus according to claim 1, wherein said power switch does not include a cover covering said power switch.

6. The image forming apparatus according to claim 5, wherein said power switch does not turn on and off power to the facsimile function.

* * * * *